US007380433B2

(12) United States Patent
Seethaler et al.

(10) Patent No.: US 7,380,433 B2
(45) Date of Patent: Jun. 3, 2008

(54) METHOD FOR CALIBRATION OF A POSITIONAL SENSOR ON A ROTATIONAL ACTUATOR DEVICE FOR CONTROL OF A GAS EXCHANGE VALVE IN AN INTERNAL COMBUSTION ENGINE

(75) Inventors: Rudolf Seethaler, Munich (DE); Ralf Cosfeld, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/798,305

(22) Filed: May 11, 2007

(65) Prior Publication Data

US 2007/0208487 A1 Sep. 6, 2007

Related U.S. Application Data

(63) Continuation of application No. PCT/EP2005/011222, filed on Oct. 19, 2005.

(30) Foreign Application Priority Data

Nov. 12, 2004 (DE) ..... 10 2004 054 759

(51) Int. Cl.
*G01B 3/30* (2006.01)

(52) U.S. Cl. ..... 73/1.79

(58) Field of Classification Search .. 123/90.16–90.23; 73/1.79

See application file for complete search history.

(56) References Cited

U.S. PATENT DOCUMENTS 6,321,700 B1 11/2001 Hein et al. ..... 123/90.11
6,659,053 B1 * 12/2003 Cecur ..... 123/90.16
7,055,475 B2 6/2006 Denteler et al. ..... 123/90.16
7,111,598 B2 9/2006 Gaubatz et al. ..... 123/90.16
2003/0136361 A1 7/2003 Ogiao ..... 123/90.11

(Continued)

FOREIGN PATENT DOCUMENTS

DE 197 39 840 A1 3/1999

(Continued)

OTHER PUBLICATIONS

International Search Report dated Jan. 25, 2006 with English translation (Six (6) Pages).

(Continued)

*Primary Examiner*—Hezron Williams
*Assistant Examiner*—Tamiko Bellamy
(74) *Attorney, Agent, or Firm*—Crowell & Moring LLP

(57) ABSTRACT

A method for calibrating a distance sensor of a rotary actuator device for controlling a charge cycle valve of an internal combustion engine. The rotary actuator device includes a controllable electric motor having an actuator element for actuating the charge cycle valve, two energy storage means acting in opposite drive directions on the charge cycle valve, a control and regulating device which controls the electric motor with regard to its rotor angle according to a stored setpoint path and a distance sensor for detecting the rotor position. At least one state variable of the electric motor is measured, the at least one state variable being compared with a reference variable. If there is a deviation between the variables being compared, the stored setpoint path and/or the distance sensor signal detected is/are altered as a function of the state variable.

13 Claims, 4 Drawing Sheets

U.S. PATENT DOCUMENTS

| | | | | |
|---|---|---|---|---|
| 2004/0069259 | A1* | 4/2004 | Shui et al. | 123/90.16 |
| 2004/0221824 | A1 | 11/2004 | Denteier et al. | 123/90.16 |
| 2006/0016408 | A1 | 1/2006 | Gaubatz et al. | 123/90.16 |

FOREIGN PATENT DOCUMENTS

| | | | |
|---|---|---|---|
| DE | 101 40 461 | A1 | 2/2003 |
| DE | 102 52 991 | A1 | 5/2004 |
| DE | 103 18 246 | A1 | 11/2004 |
| WO | WO 2004/097184 | | 11/2004 |

OTHER PUBLICATIONS

German Search Report dated Aug. 1, 2005, with English translation (Four (4) Pages).

* cited by examiner

P_Opening
P_Closing
RW
WP
IB
SB
0
t v
0
t

I, M
0
t

SB
RW
IB
WP
0
t v
0
t

I, M
0
t

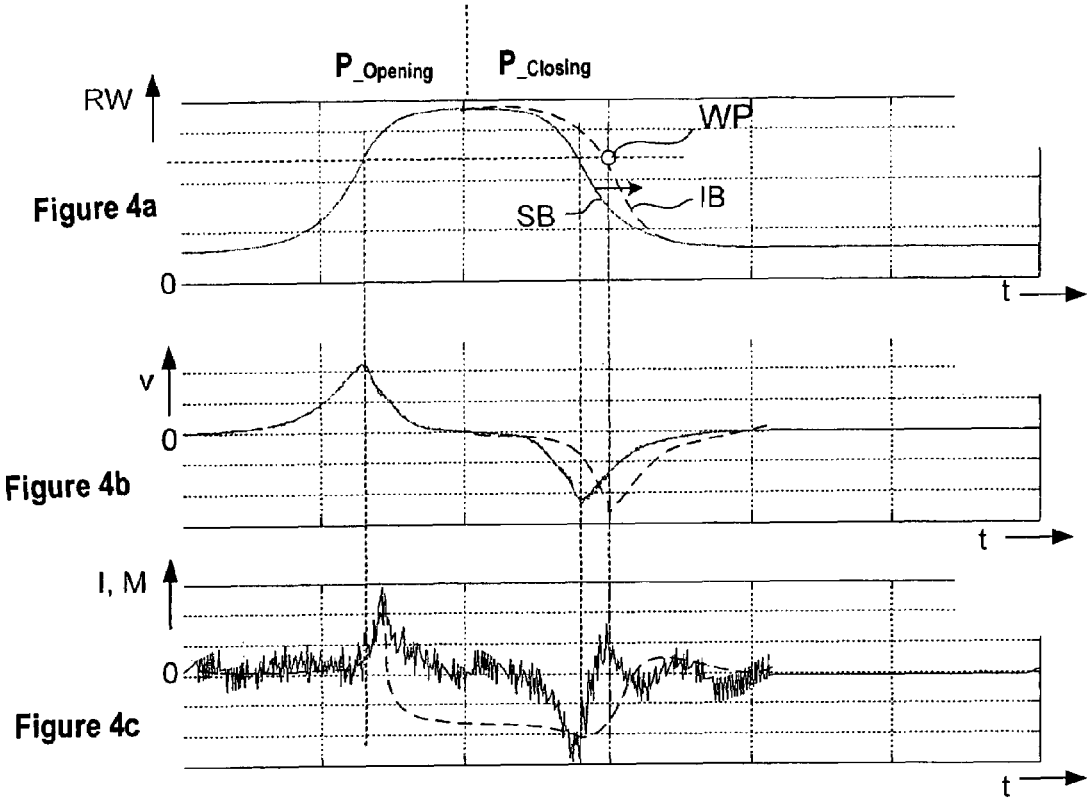
Figure 4a
Figure 4b
Figure 4c
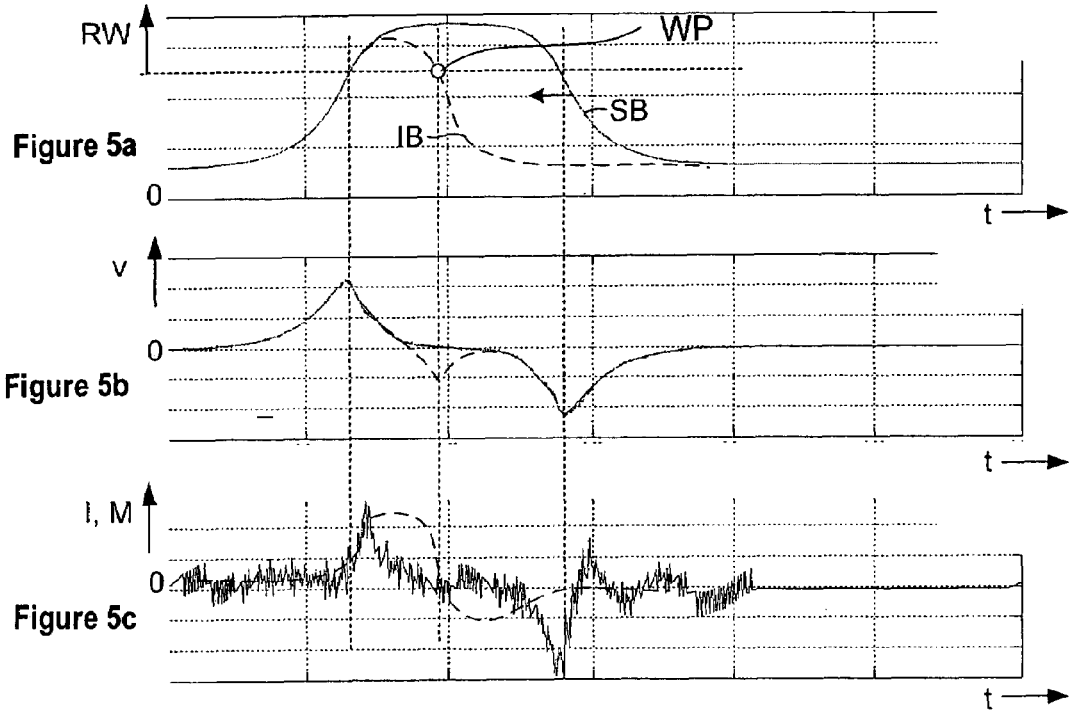
Figure 5a
Figure 5b
Figure 5c

METHOD FOR CALIBRATION OF A POSITIONAL SENSOR ON A ROTATIONAL ACTUATOR DEVICE FOR CONTROL OF A GAS EXCHANGE VALVE IN AN INTERNAL COMBUSTION ENGINE

This application is a Continuation of PCT/EP2005/011222, filed Oct. 19, 2005, and claims the priority DE 10 2004 054 759.9, filed Nov. 12, 2004, the disclosures of which are expressly incorporated by reference herein.

BACKGROUND AND SUMMARY OF THE INVENTION

The present invention relates to a method for calibrating a distance sensor of a rotary actuator device for controlling a charge cycle valve of an internal combustion engine. In particular, this method is applied here to rotary actuator devices without mechanical end stops.

In traditional internal combustion engines, the camshaft for controlling the charge cycle valves (also known as gas exchange valves) is driven mechanically by the crankshaft via a control chain or a control belt. To increase engine power and reduce fuel consumption, considerable advantages are achieved by controlling the valves of the individual cylinders individually. This is possible for a so-called fully variable valve drive (variable control times and variable valve lift), e.g., a so-called electromagnetic valve drive. With a fully variable valve drive, an "actuator unit" is allocated to each valve and/or each "valve group." At the present time, different basic types of actuator units are being researched.

With one basic type (so-called lift actuators) an opening magnet and a closing magnet are allocated to a valve or a valve group. By applying electric power to the magnets, the valves can be displaced axially, i.e., opened and/or closed.

With the other basic type (so-called rotary actuator) a camshaft is provided with cams whereby the control shaft is pivotable back and forth by an electric motor.

To regulate a rotary actuator, extremely accurate sensor values are required, providing information about the instantaneous position of the rotary drive element and/or the element driving the drive element of the rotary actuator itself, e.g., the position of the actuator element driven by the rotor (e.g., the camshaft) or the rotor position itself In known rotary actuator devices, distance sensors are calibrated by the approach to mechanical stops, which define the end positions of a control cam.

German Patent Document DE 101 40 461 A1 describes a rotary actuator device for control of the lift of a charge cycle valve with such mechanical stops. The lift control of the charge cycle valves is accomplished here by an electric motor which is itself controlled by characteristics maps and which has a shaft with a control cam connected to it in a rotationally fixed manner arranged on the rotor of the electric motor. During operation of the internal combustion engine, the rotor of the electric motor swings, i.e., oscillates back and forth, and the control cam periodically forces the charge cycle valve into its open position by means of a pivot lever. The charge cycle valve is closed by the spring force of a valve spring. In order for the electric motor not to have to overcome the entire spring force of the valve spring when opening the charge cycle valve, an additional spring is mounted on the shaft. The forces of the valve spring and additional springs are such that in periodic operation of the rotary actuator device, the kinetic energy is either stored in the valve spring (closing spring) or in the additional spring (opening spring) in accordance with the position of the charge cycle valve. The invention is directed to unambiguously positioning the control cam by a first rotary stop and a second rotary stop, thereby unambiguous positioning of the control cam in its end positions. However, one disadvantage of this arrangement is that the calibration of distance sensors for determining the position by approach to mechanical stops does not have a satisfactory precision for all applications. Depending on the design of the rotary actuator device used, the mechanical tolerances of the systems are so great that the required accuracy cannot be achieved.

An object of this invention is to provide a method for measuring and calibrating a distance sensor for a rotary actuator device by which more accurate positioning, and/or determination of the position of the actuator element (and thus also the gas exchange value) is ensured. In particular, a method is to be provided which reliably ensures a measurement and/or calibration in operating phases when the rotational speed of the internal combustion engine is low as well as in operating when the rotational speed of the internal combustion engine is high.

According to this invention, this object is achieved by at least one state variable of the electric motor being determined and compared with a stored reference quantity. In the event of a deviation between the state variable so determined and the reference quantity with which it is to be compared beyond a predetermined value, the stored setpoint path on the basis of which the electric motor and/or the rotor of the electric motor is regulated and/or the value determined by the distance sensor is altered as a function of the size of the deviation of the state variable from the reference value.

The state variable is preferably determined by measuring the corresponding value. As an alternative, however, the state variable may also be calculated on the basis of a stored model. The rotor angle, a time derivation of the rotor angle and/or the electric power of the electric motor or a quantity proportional to the motor current (motor power, supply voltage of the electric motor) is preferably determined as the state variable of the rotor angle.

The change in the stored setpoint path and/or the distance sensor value measured preferably takes place by multiplying the stored setpoint path values and/or distance sensor values times a correction factor and/or by adding a stored offset value. The correction factor and/or offset value are referred to below as the correction value. The correction value is determined as a function of the distance deviation measured. This determination may be performed by selection from a stored table or by online calculation. In the case of a high distance deviation (above a predetermined first deviation threshold) on the basis of which the rotor threatens to drop to an unwanted intermediate position, for example, a correspondingly high correction value is assigned so that directly in the same work cycle or in the immediately following work cycle of the rotor, this value is regulated on the basis of strongly corrected values. A drop in the rotor into the intermediate position described here is thus effectively prevented. In the case of a smaller path deviation, the existence of which does not mean a drop in the rotor is imminent, the at least one monitored state value which is determined in each working cycle or in every n-th working cycle may be averaged over a number of working cycles. An assignment and/or determination of a corresponding correction factor is/are then performed in particular on the basis of the averaged correction factor. A working cycle in the sense of the present invention is a term referring to the opening or closing process of a charge cycle valve in particular and/or the respective swiveling operation of the rotor of the electric motor immediately thereafter. A definition of the working play that includes the closing process and the opening process is also possible.

Since no gas backpressures need be taken into account during the closing process, the inventive method is preferably used in calibration of the distance sensor during the closing process of the charge cycle valve assigned to the distance sensor.

The method according to this invention includes in particular two different strategies for measuring, i.e., calibrating the rotary actuator. The first strategy consists of determining minor deviations in the rotor from the predetermined setpoint path on the basis of which it is regulated to detect, to average them over a plurality of working cycles and, depending on the averaged deviation, to make a change in the setpoint path on the basis of which the rotor is then regulated in the future and/or to alter the distance sensor signals such that a distance characteristic corrected accordingly will be regulated in the future on the basis of the modified distance sensor signals. This strategy thus extends in time over several working cycles (slow intervention). In contrast with that, the second strategy consists of counteracting major deviations with a rapid regulating intervention. This is done by the fact that the regulation of the rotor is already performed in the same working cycle or in the next working cycle on the basis of the altered values for the setpoint path and/or the distance sensor signals by means of a corresponding change in the setpoint path and/or the distance sensor signals. The two strategies also differ, however, in the measures to be taken, which will be discussed after the following description of the figures.

Other objects, advantages and novel features of the present invention will become apparent from the following detailed description of the invention when considered in conjunction with the accompanying drawings.

BRIEF DESCRIPTION OF THE DRAWINGS

FIGS. 4*a-c* show the state variable according to FIGS. 2*a-c* for the case when the rotor moves beyond the setpoint end position due to a distance sensor defect of a larger extent, FIGS. 5*a-c* show the state variable according to FIGS. 3*a-c* for the case when the rotor does not reach the setpoint end position due to a distance sensor defect of a larger extent.

DETAILED DESCRIPTION

Figure 1:
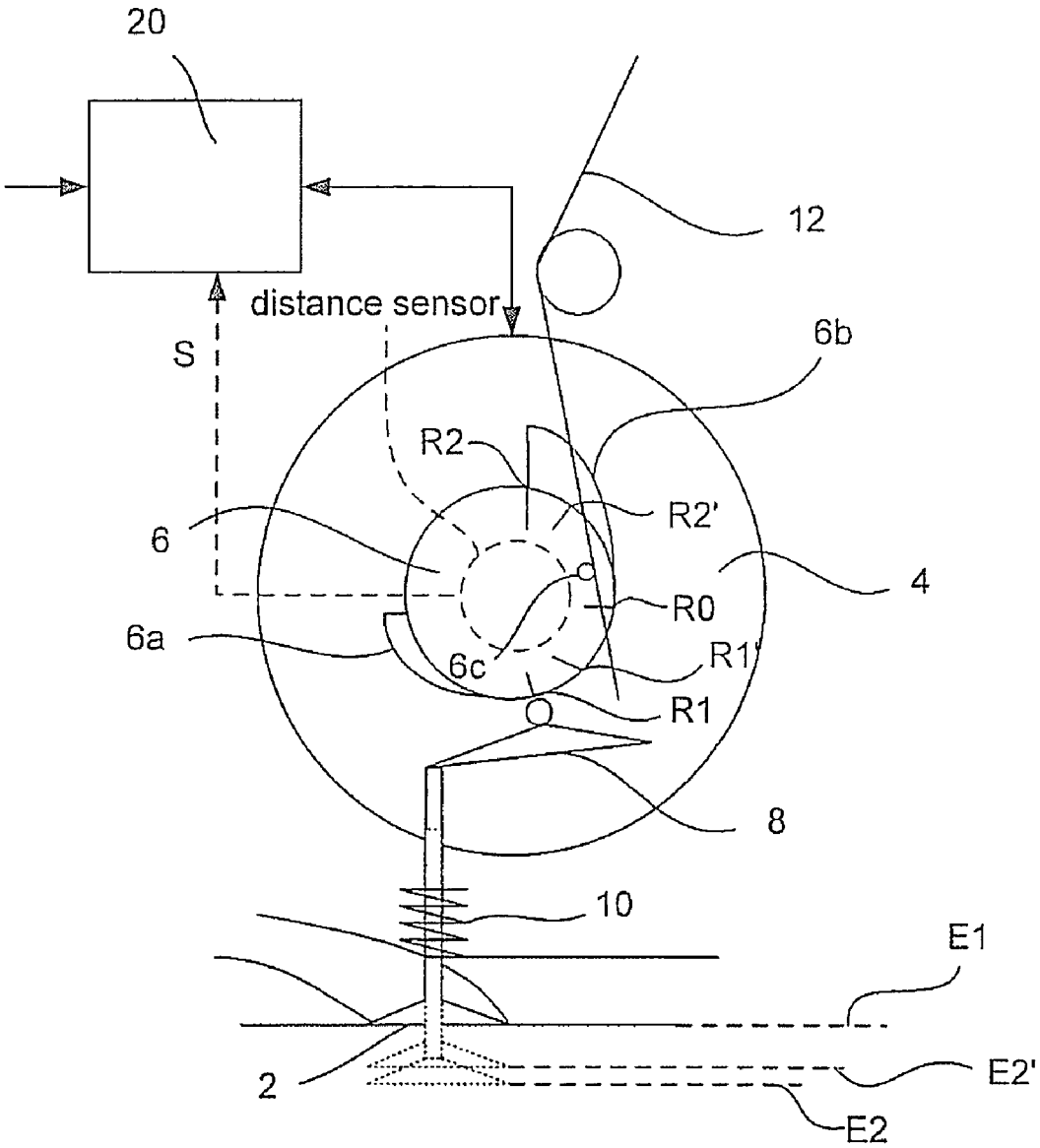
FIG. 1 shows a schematic diagram of a rotary actuator device for the drive of a charge cycle valve of an internal combustion engine (not shown)

FIG. 1 shows a schematic diagram of a rotary actuator device for the drive of a gas exchange value 2 of an internal combustion engine (not shown). The essential components of this device include an electric motor 4 (drive mechanism) designed in particular as a servomotor, a camshaft 6 (actuator element) driven by the electric motor, preferably having two cams 6*a*, 6*b* of different lifts, the camshaft connected to the rotor shaft in a rotationally fixed manner, a drag lever 8 (transfer element) which is in operative connection to the camshaft 6 on the one hand and to the charge cycle valve 2 on the other hand, for transferring the motion of the lift height, which is predetermined by the cams 6*a*, 6*b*, to the charge cycle valve 2, and a first energy storage means 10, which is designed as a closing spring and acts on the charge cycle valve 2 with a spring force in the closing direction, and a second energy storage means 12, which is designed as an opening spring and acts upon the charge cycle valve 2 with an opening force via the camshaft 6 and a roller lever 8. Reference is made to German Patent Document DE 102 52 991 A1 for the exact functioning and mechanical design of the rotor actuator device, the text of said patent being included in the disclosure content of the present patent application with regard to the design of the rotary actuator.

To ensure operation of the electric motor 4 with the lowest possible power consumption, said electric motor driving the present charge cycle valve 2 via the camshaft 6, the electric motor 4 is regulated via a control and regulating device 20 (hereinafter referred to as the regulating device) according to a setpoint path which maps the ideal transient characteristic of the spring-mass-spring system-in addition to optimal design of the mutually counteracting springs (closing spring 10, opening spring 12) and the ideal positioning of the fulcrums and hinge points in the geometry of the device itself. In particular this regulation is accomplished by regulating the rotor characteristic of the electric motor 4 which drives the at least one actuator element 6, 6*a*, 6*b*. The ideal distance characteristic of the rotor, which also oscillates as part of the oscillation system, is calculated by analogy with the ideal vibration characteristic of the system as a whole and thus forms the setpoint path for regulating the electric motor 4. For monitoring the actual position of the rotor, there is a distance sensor (schematically illustrated by dashed lines) which transmits a sensor signal S to the regulating device 20 or some other control device. The electric motor 4 is controlled by the regulating device 20 such that the at least one charge cycle valve 2 is transferred from a first valve end position E1, which corresponds to the closed valve position, for example, into a second valve end position E2, E2', which corresponds to a partially open valve position (E2': partial lift) or maximally opened (E2: full lift) valve position and vice versa. In regulating the electric motor 4, the rotor and thus the actuator element 6, 6*a*, 6*b* which is operatively connected to the rotor is controlled accordingly in position so that the rotor and/or the actuator element 6, 6*a*, 6*b* will assume a position in the distance range of the cam base circle, e.g., in the distance range between R1 and R1', by analogy with the closed position E1 of the charge cycle valve 2, and by analogy with the second end position E2, E2' a position in the distance range of the cam 6*a*, 6*b*, e.g., in the distance range between R2 and R2'. The system is ideally designed so that the actuator elements 6, 6*a*, 6*b* will travel the distance between two end positions R1, R2 (full lift) or R1', R2' (partial lift) without any input of additional energy, i.e., without an active drive by the drive device 4 when ambient influences (in particular friction and gas backpressure) are excluded (by intentionally disregarding them) and therefore the actuator element will intervene in a supporting manner only under the ambient influences that occur in practice. This system is preferably designed so that it is in a metastable torque-neutral position at the maximum end positions R1, R2 of the rotor (vibration end positions at maximum vibration stroke) in which the forces occurring are in equilibrium and the rotor is stopped without applying any additional holding force.

In particular, the charge cycle valve 2 in the first metastable and torque-neutral position R1 (shown in FIG. 1) is closed and thus the closing spring 10 is maximally relaxed while retaining a residual prestress while the opening spring 12 is maximally prestressed. The force of the prestressed opening spring 12 is transferred to the camshaft 6 via a stationary supporting element 6*c* thereof and is directed exactly through the midpoint of the camshaft 6 in position R1 and is thus more or less neutralized. The force of the closing spring 10 which also occurs due to the residual prestress is neutralized in the position described because it is also directed at the midpoint of the camshaft 6 via the drag lever 8.

In the second metastable and torque-neutral position R2 (not shown here) the charge cycle valve 2 would be opened with its maximal lift according to the main cam 6*b* and the closing spring 10 arranged around the charge cycle valve 2 would be maximally prestressed, while the opening spring 12 would be maximally relaxed while retaining a residual prestress. The arrangement of the individual components is selected so that the force of the maximally prestressed spring means (now: closing spring 10) and the force of the maximally relaxed spring means (now: opening spring 12) are each directed exactly through the midpoint of the camshaft 6 and are thus being more or less neutralized in this position.

A third stable and torque-neutral position R0, also not shown, occurs when the system assumes a so-called fallen state in which the camshaft 6 assumes a position between the first two metastable and torque-neutral positions R1, R2. The system can be brought back out of the fallen position only by means of a high energy consumption, e.g., in that the camshaft 6 is brought back into one of the first two metastable torque-neutral positions R1, R2, by a startup or ramp up of the rotor or the camshaft 6 is ramped up at least to a partial lift at which regular operation of the rotor actuator device is again possible.

By analogy with the three torque-neutral positions R0, R1, R2 described here for operation of the device by means of the main cam 6*b*, there may be additional positions (not shown) for a so-called minimal lift operation in actuation of the second cam 6*a*. For these additional three torque-neutral positions, the same statements as those made for the torque-neutral positions R0, R1 and R2 described above are also applicable here.

With the calculated ideal transient characteristic, the rotor thus oscillates from one end position E1, E1' into the other end position E2, E2' merely on the basis of the energy stored in the energy storage means 10, 12 without any input of additional energy, e.g., by the electric motor 4.

In the case when the rotor in partial-lift operation oscillates from a first end position R1' to a corresponding second end position R2' (in particular at high rotational speeds of the internal combustion engine), the ideal transient characteristic would thus be that of a perpetual motion machine (infinite uniform oscillation).

For the case when the rotor in full-lift operation oscillates from a first end position R1 to a corresponding second end position R2 (in particular at idling mode and/or at low rotational speeds of the internal combustion engine), it would be held in the end positions R1, R2 in a torque-neutral position and would have to be prompted out of this position by input of a pulse-like thrust energy (engine pulse) to execute the next oscillation into the other end position (therefore a metastable torque-neutral position).

Due to the fact that the setpoint paths for full lift and partial lift correspond to the transient characteristic of the rotary actuator device without friction losses and without gas backpressures, this ensures that the regulating device 20 will control the electric motor 4 exclusively to equalize the frictional losses and the gas backpressures that always occur in practice. Since friction losses occur mainly at high rotational speeds of the rotor, the electric motor 4 must deliver the greatest power at high rotational speeds. Since this coincides with the energy-optimal operating point of the electric motor 4, energy-saving operation of same can be ensured by regulation on the basis of idealized setpoint paths of the actuator system to be operated.

FIG. 2 and FIG. 3 each show in three different diagrams a through c the state variables, i.e., rotor angle, rotor angular velocity and torque delivered and power consumption by the electric motor for the case of minor distance sensor errors, while FIG. 4 and FIG. 5 by analogy with FIG. 2 and FIG. 3 show the state variable for the case of greater distance sensor errors. In FIG. 2 through FIG. 5 the setpoint values and/or the values to be expected on the basis of the setpoint path are each represented as uninterrupted lines and the actual values established on the basis of a deviation are shown as dotted lines.

Figures 2A, 2B, 2C, 3A, 3B, 3C:
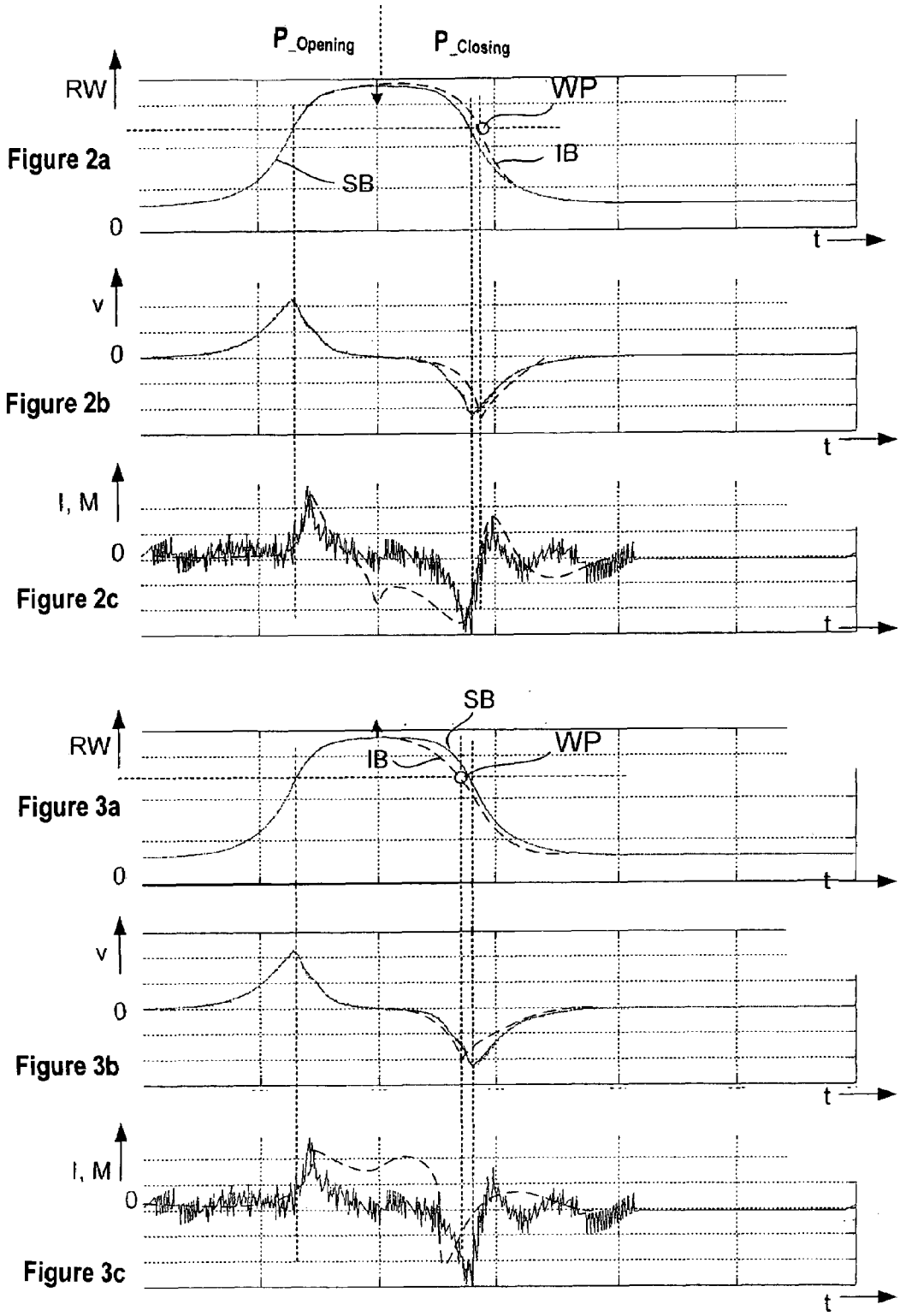
FIGS. 2*a-c* illustrate the state variables in an embodiment of the present invention in three different diagrams: rotor angle, rotor angular velocity and torque delivered and/or electric power consumption by the electric motor for the case when the rotor moves beyond the setpoint end position due to a distance sensor defect of a minor extent.
FIGS. 3*a-c* illustrate in three different diagrams the state variables in an embodiment of the present invention: rotor angle, rotor angular velocity and torque delivered and/or electric power consumption by the electric motor for the case when the rotor does not reach the setpoint end position due to a distance sensor defect of a minor extent.

FIGS. 2*a-c* describe the case when the rotor of the electric motor 4 moves beyond the setpoint end position because of an error-laden distance sensor signal S (errors of a smaller extent—within a predetermined first deviation range and/or beneath a first deviation threshold). The distance sensor is calibrated by analyzing the state variables of the electric motor 4, preferably during the closing phase $P_{closing}$ of a charge cycle valve 2. The rotor setpoint value predetermined by the setpoint path is preselected in its end position by R2; R2' (and/or the respective rotor angle RW(R2); RW(R2')), whereby the end position should be reached exactly at the cut-off point between the opening phase $P_{opening}$ and the closing phase $P_{closing}$. Owing to an error-laden distance sensor signal S, which suggests to the regulating device 20 on reaching the desired rotor end position at R2; R2' (setpoint rotor end position) that the end position is not yet reached, at the turning point in time WP of the rotor movement, the expected maximal velocity is exceeded (comparison of the actual path IB established on the basis of the regulation for the rotor angle characteristic with the predetermined setpoint path SB on the basis of which the rotor angle specifies an increased motor power consumption (and/or torque output) on the basis of the (error-laden) and already before the turning point in time WP in the time range B1 (FIG. 2*c*)). Depending on the size of the deviation of at least one of the two state variables (rotor angular velocity, motor power consumption and/or electric motor torque delivered) from the respective setpoint value of the state variable, a correction value for equalizing the prevailing error is determined. To do so, the setpoint path to be corrected and/or the distance sensor (value) to be corrected is/are subject to a correction factor (multiplication) and/or an offset (addition).

By analogy with FIGS. 2*a-c*, FIGS. 3*a-c* illustrate the case in which the rotor of the electric motor 4 does not reach the desired setpoint end position because of an error-laden distance sensor signal S (error of a smaller extent—within a predetermined first deviation range). Owing to a prevailing error-laden distance sensor signal S, it is suggested to the regulating device 20 that even before reaching the desired rotor end position at R2; R2' (setpoint rotor end position), this end position has already been reached (comparison of the actual path IB established on the basis of the regulation for the rotor angular characteristic with the predetermined setpoint path SB on the basis of which the rotor angle was regulated on the basis of the (error-laden) distance sensor signals). At the turning point in time WP in the rotor movement, the expected maximal velocity is thus not reached accordingly (FIG. 3*b*) and an increased engine power consumption (and/or torque output) is recorded already before the turning point in time WP (FIG. 3*c*). Depending on the size of the deviation of at least one of the two state variables (angular velocity of the rotor, power consumption by the motor and/or electric motor torque delivered) at the respective setpoint value of the state variable, here again a correction term is determined for equalizing the given error. To do so, the setpoint path to be corrected and/or the distance sensor (value) to be corrected is subject to a correction factor (multiplication) and/or an offset (addition).

Thus in the case when the value falls below the predetermined setpoint value within a predetermined range, the change in the setpoint path SB and/or the distance sensor signal S is performed in such a way that an increased maximal lift of the charge cycle valve 2 is achieved during a later working cycle (in comparison with the maximal lift achieved in the case of error-laden distance sensor signals according to actual path IB) and for the case when the setpoint value is exceeded, the change in the setpoint path SB and/or the distance sensor signal S is performed in such a way that a reduced maximal lift of the charge cycle valve 2 is achieved during a later working cycle. In this way, there is essentially a targeted shift in the end stops defined by the regulating technology (and thus an adjustment of the maximal lift) for the rotor of the electric motor.

In the case of a larger deviation (distance sensor error of a greater extent—outside of a predetermined second deviation range and/or exceeding a second deviation threshold), counterregulation is implemented immediately by a rapid intervention (FIGS. 4*a-c*, FIGS. 5*a-c*) by regulating the rotor on the basis of an altered setpoint path SB and/or an altered distance signal S of a newly calibrated distance sensor by means of a correction value (correction factor and/or offset) allocated to the given deviation as soon as possible during the same working cycle and/or the current working cycle, but at the latest in the next working cycle of the rotor. In doing so, a change in the setpoint path SB and/or the distance sensor signal S is performed due to a deviation between the measured state variable and the reference variable outside of a predetermined range such that the rotor is preferably still regulated in the same working cycle on the basis of an altered setpoint path and/or an altered distance sensor signal and the maximal lift is shifted in the following working cycle (without averaging of the measured variables over several working cycles). In particular in the case when the value falls below the setpoint value outside of the predetermined range, the change in the setpoint path SB and/or the distance sensor signal S is performed in such a way that a premature closing process of the charge cycle valve 2 is achieved during the same working cycle and the maximal lift is increased in the next working cycle (without averaging the measured variables over several working cycles) and thus a later closing point in time is again set. For the case when the value exceeds the setpoint value outside of the predetermined range, the change in the setpoint path SB and/or the distance sensor signal S takes place in such a way that a delayed closing process of the charge cycle valve 2 is achieved during the same working cycle and the maximal lift is reduced in the following working cycle (without averaging the measured variables over several working cycles) and an earlier closing point in time is again set. In this way, a rapid shift in the closing control edge of the predetermined setpoint path SB is essentially achieved.

Figure 6:
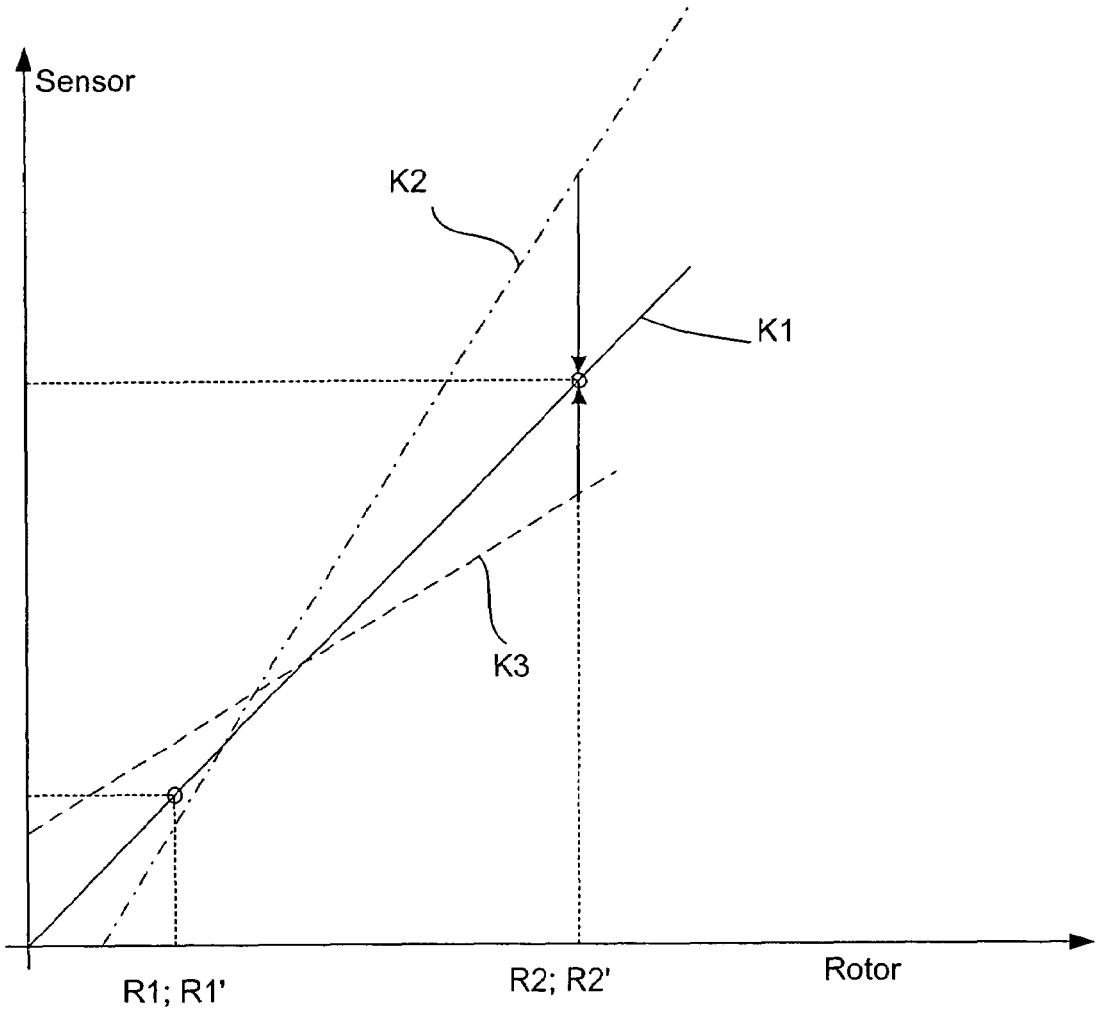
FIG. 6 shows the linear relationship in an embodiment of the present invention between the distance sensor and the rotor angle in the case with errors and in the case with no errors.

FIG. 6 shows the linear relationship between the signal S of the distance sensor (which maps the position of the rotor) and the rotor angle RW of the rotor 4 actually set. In the error-free ideal case, for example, a characteristic line according to K1 with the origin at the zero point, for example, is set. If there is now an error-laden distance sensor signal S, then a characteristic line/straight line according to K2 or K3 is usually established, each being rotated by one point on the error-free straight line. As already explained above, any error-laden characteristic line can again be converted to an error-free characteristic line by a calculated correction—e.g., by multiplying it times the correction factor and adding an offset (in general: sensor_correction=sensor_actual×correction factor+offset). On the basis of the corrected characteristic line, the distance sensor can again supply error-free signals to the regulating device 20. As an alternative to the correction of the distance sensor signals S, the setpoint path SB may also be adapted for regulation of the rotor or both correction options may be performed in parts.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for calibrating a distance sensor of a rotary actuator device for controlling a charge cycle valve of an internal combustion engine, wherein the rotary actuator device includes a controllable electric motor having an actuator element for actuating the charge cycle valve, two energy storage means acting on the charge cycle valve in opposite drive directions, a control and regulating device which controls the electric motor with regard to a rotor angle according to a stored setpoint path such that the rotor of the electric motor is moved from a first end position into a second end position and vice versa, and a distance sensor for detecting rotor position, comprising the acts of:

measuring at least one state variable of the electric motor;

comparing the at least one state variable with a reference variable;

determining whether there is a deviation between said variables; and altering at least one of the stored setpoint path and the distance sensor signal as a function of the state variable.

2. The method as claimed in claim 1, wherein at least one of the rotor angle, a time derivation of the rotor angle, a power consumption and a supply voltage of the electric motor is measured as the state variable for the electric motor.

3. The method as claimed in claim 1, wherein the adaptation of at least one of the setpoint path and the distance sensor signal is accomplished by multiplication by a correction factor.

4. The method as claimed in claim 2, wherein the adaptation of at least one of the setpoint path and the distance sensor signal is accomplished by multiplication by a correction factor.

5. The method as claimed in claim 1, wherein the adaptation of at least one of the setpoint path and the distance sensor signal is accomplished by addition of an offset value.

6. The method as claimed in claim 2, wherein the adaptation of at least one of the setpoint path and the distance sensor signal is accomplished by addition of an offset value.

7. The method as claimed in claim 1, wherein the distance sensor is calibrated during a closing process of the charge cycle valve assigned to the distance sensor.

8. The method as claimed in claim 1, wherein when the deviation between the measured state variable and the reference variable is outside of a predetermined range, a change in at least one of the setpoint path and the distance sensor signal is implemented in a next working cycle such that the rotor is regulated on the basis of at least one of an altered setpoint path and an altered distance sensor signal.

9. The method as claimed in claim 8, wherein when a difference between an actual position of the rotor and predetermined setpoint end position is within a predetermined distance when the deviation between the measured state variable and the reference variable is outside of a predetermined range, the change in at least one of the setpoint path and the distance sensor signals is accomplished such that during a current working cycle, an early closing process of the charge cycle valve is achieved, and when a difference between an actual position of the rotor and predetermined setpoint end position exceeds the predetermined distance, the change in at least one of the setpoint path and the distance sensor signal is accomplished such that a delayed closing process of the charge cycle valve is achieved during the current working cycle.

10. The method as claimed in claim 1, wherein when the deviation between the measured state variable and the reference variable is within a predetermined range, a change in at least one of the setpoint path and the distance sensor signal is implemented after a plurality of working cycle such that the rotor is regulated on the basis of at least one of an altered setpoint path and an altered distance sensor signal.

11. The method as claimed in claim 10, wherein when a difference between an actual position of the rotor and predetermined setpoint end position is within a predetermined distance when the deviation between the measured state variable and the reference variable is within a predetermined range, the change in at least one of the setpoint path and the distance sensor signals is accomplished such that an increased maximal lift of the charge cycle valve is achieved during a later working cycle, and when a difference between an actual position of the rotor and predetermined setpoint end position exceeds the predetermined distance, the change in at least one of the setpoint path and the distance sensor signal is accomplished such that a reduced maximal lift of the charge cycle valve is achieved during a later working cycle.

12. The method as claimed in claim 10, wherein the state variable measured is averaged over a plurality of working cycles and a change in at least one of the setpoint path and the distance sensor signal is made on the basis of the averaged state variable.

13. The method as claimed in claim 11, wherein the state variable measured is averaged over a plurality of working cycles and a change in at least one of the setpoint path and the distance sensor signal is made on the basis of the averaged state variable.

* * * * *